US006848919B2

(12) United States Patent
Stitz et al.

(10) Patent No.: US 6,848,919 B2
(45) Date of Patent: Feb. 1, 2005

(54) MAGNET COIL ARRANGEMENT

(75) Inventors: Matthias Stitz, Lohr (DE); Karl-Heinz Wittig, Schleusingen (DE); Hans-Jürgen Kern, Schleusingen (DE)

(73) Assignees: Bosch Rexroth AG, Lohr/Main (DE); Kern Technik GmbH & Co. KG, Schleusingen (DE)

( * ) Notice: Subject to any disclaimer, the term of this patent is extended or adjusted under 35 U.S.C. 154(b) by 0 days.

(21) Appl. No.: 10/474,278

(22) PCT Filed: Apr. 3, 2002

(86) PCT No.: PCT/EP02/03667

§ 371 (c)(1),
(2), (4) Date: Apr. 29, 2004

(87) PCT Pub. No.: WO02/089155

PCT Pub. Date: Nov. 7, 2002

(65) Prior Publication Data

US 2004/0183650 A1 Sep. 23, 2004

(30) Foreign Application Priority Data

Apr. 23, 2001 (DE) ..... 101 19 939

(51) Int. Cl.[7] ..... H01R 13/44
(52) U.S. Cl. ..... 439/130; 336/90
(58) Field of Search ..... 439/130, 271; 336/90; 338/192

(56) References Cited

U.S. PATENT DOCUMENTS 5,710,535 A * 1/1998 Goloff ..... 336/192
6,118,361 A * 9/2000 Ogawa ..... 336/96

FOREIGN PATENT DOCUMENTS

DE 198 54 100 A1 * 5/2000

* cited by examiner

*Primary Examiner*—Tho D. Ta
(74) *Attorney, Agent, or Firm*—Martin A. Farber

(57) ABSTRACT

According to the invention, the coil of a magnet coil arrangement has a coil body which comprises a winding (14) and is extruded with plastic (17). A plug-in base with contact connectors is formed on the coil, wherein one of the connectors is used for connection of the grounding conductor (18). A metallic housing is placed over the coil. Connection of said metallic housing to the contact connector associated to the grounding conductor is achieved by means of a connection element which is guided through a recess of the plug-in base. A sealing element (42) disposed between the connection element and the recess prevents penetration of a fluid from a region between the metallic housing and the coil, into the region where a connector is connected to the contact connectors. In order to improve the electrical connection between the contact connector associated to the grounding conductor and the metallic housing, for a connection element (31) which is threaded in the metallic housing, a cylindrical metallic part is placed between the contact connector and the metallic housing. A respective sealing element (41, 42) is placed between the connection element and the metallic cylindrical part as well as between said part and the recess of the plug-in base. Such magnet coil arrangements are used in electromechanically-controlled hydraulic valves in which metallic parts accessible from outside must be connected to a grounding conductor.

9 Claims, 3 Drawing Sheets

MAGNET COIL ARRANGEMENT

FIELD AND BACKGROUND OF THE INVENTION

The invention relates to a magnet coil arrangement having an encapsulated coil, which comprises a coil former that is provided with a winding and is extrusion coated with plastic, and having a metal housing which is pushed over the encapsulated coil and surrounds it, as claimed in the pre-characterizing clause of claim 1.

A magnet coil arrangement of this type is known from DE 198 54 100 A1. A coil former which is provided with a winding is extrusion coated with plastic and forms an encapsulated coil. A plug cap is integrally formed on the encapsulated coil. Contact lugs are held in the plug cap, two of which are connected to the ends of the winding, while a third is associated with the protective ground conductor connection. The electrical connection is made via a connecting plug which is plugged onto the contact lugs. The housing of the connecting plug provides an external seal for the contact area which is formed by it and the plug cap. A metal housing is pushed over the encapsulated coil. In the process, the metal housing engages in a recess between the plug cap and the outer surface of the encapsulated coil. The plug cap is provided with a recess, through which a connecting element is passed. The connecting element produces the electrical contact between the metal housing and the contact lug that is associated with the protective ground conductor connection. A sealing element is arranged between the connecting element and the recess in the plug cap and rests both on the circumferential surface of the connecting element and on the inner surface of the recess in the plug cap, forming a seal. The sealing element prevents moisture which has penetrated in between the outer surface of the encapsulated coil and the metal housing from being able to reach the connection area. In one exemplary embodiment, the connecting element is in the form of a screw, which is passed through a hole in the contact lug that is associated with the protective ground conductor connection, and whose thread is screwed into the metal housing. In this case, the contact lug is clamped in between the head of the screw and the plug cap. Even if the screw is tightened during assembly with a torque which is sufficient to make electrical contact, it is impossible to preclude the possibility of the plastic of the plug cap changing its characteristics over the course of time, in particular shrinking or changing its elasticity. This can lead to the contact resistance between the contact lug and the screw head becoming greater, such that an adequate electrical contact is no longer provided. There is no such risk when the connecting element—as in another exemplary embodiment in DE 198 54 100 A1—is connected to the contact lug and the metal housing via a metallic push connection in each case. In this situation, any change in the characteristics of the plastic that is used for the plug cap has no disadvantageous influence on the electrical contact resistance between the contact lug and the connecting element, or between this and the metal housing.

The invention is based on the object of ensuring a permanent electrical contact between the contact lug and the metal housing in a magnet coil arrangement of the type mentioned initially, even when the contact lug that is associated with the protective ground conductor connection is connected to the metal housing by means of a screw connection.

This object is achieved according to the invention by the features wherein a component is connected by a force fit to the tubular metal part which is arranged between the contact lug and the metal housing, and this component ensures that a reliable electrical contact is made in the long term, irrespective of the material characteristics of the plastic that is used for the plug cap.

Advantageous developments of the invention concern the design of configuration of the connecting element between the contact lug and the metal housing, including the electrically conductive connection between the contact lug, the connecting element and the metal housing, as well as to the configuration of the sealing elements which are arranged between the connecting element and the cutout in the plug cap.

BRIEF DESCRIPTION OF THE DRAWINGS

The invention will be explained in more detail in the following text, with its further details, with reference to exemplary embodiments which are illustrated in the drawings, in which.

DETAILED DESCRIPTION OF THE PREFERRED EMBODIMENT

Identical components are provided with the same reference symbols.

Figure 1:
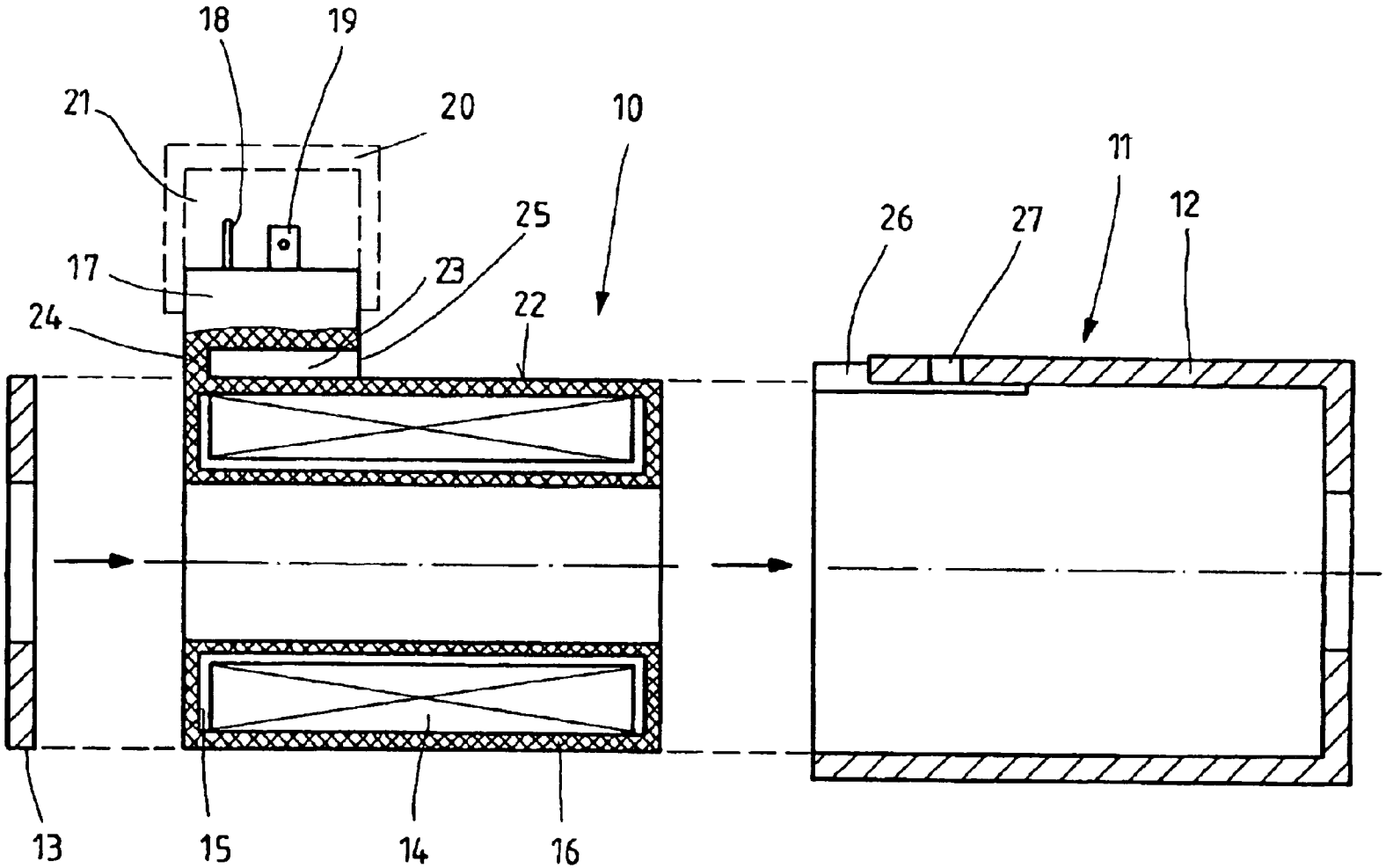
FIG. 1 shows the mechanical configuration of the magnet coil arrangement according to the invention, in the form of an exploded drawing.

FIG. 1 shows the mechanical configuration of a magnet coil arrangement according to the invention, in the form of an exploded drawing. The magnet coil arrangement comprises an encapsulated coil 10 and a metal housing 11, which is formed from a coil pot 12 and a pole plate 13. The encapsulated coil 10 comprises a coil former 15, which is provided with a winding 14, is extrusion-coated with plastic 16, and on which a plug cap 17 which is provided with three contact lugs is integrally formed. The cross section of the contact lugs is rectangular. Only the contact lugs 18 and 19, of the three contact lugs, can be seen in FIG. 1. The contact lug 18 is associated with the protective ground conductor connection. The contact lug 19 is connected to one of the two winding ends of the coil 14. The contact lug which is connected to the other winding end of the coil 14 is concealed by the contact lug 19. The electrical conductors are connected to the magnet coil arrangement via a connecting plug, whose housing is illustrated schematically in FIG. 1 and is provided with the reference symbol 20. The housing 20 of the connecting plug provides an external seal for the contact area 21 that is formed by the plug cap 17 and the housing 20. A recess 23 is provided between the plug cap 17 and the outer surface 22 of the encapsulated coil 10. The plug cap 17 is held on the encapsulated coil 10 via a web 24 and a further web 25, which extends in the longitudinal direction of the encapsulated coil 10 and bounds the recess 23.

Figure 2:
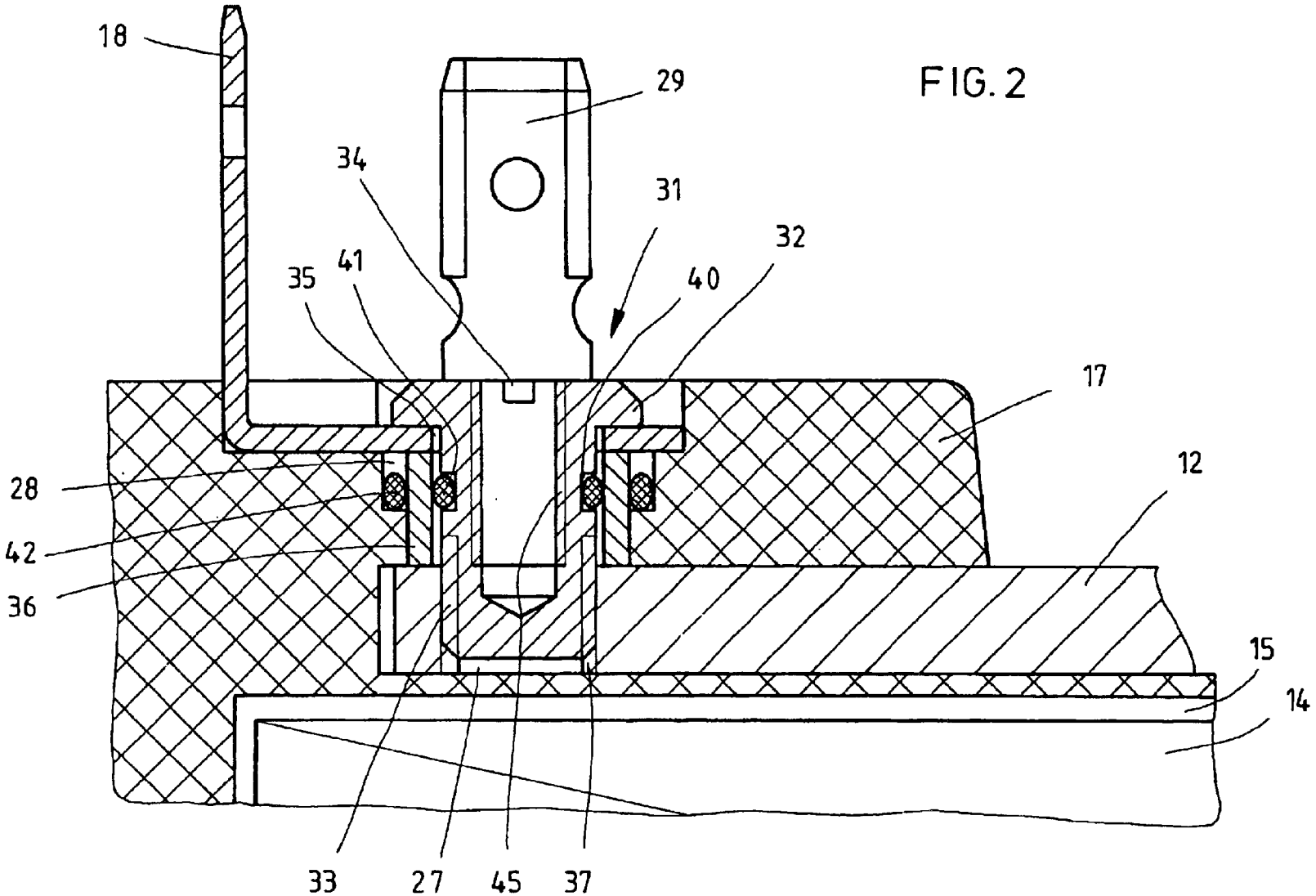
FIG. 2 shows a section through a detail of the magnet coil arrangement illustrated in FIG. 1, on an enlarged scale, in which a tubular metal part is arranged between the contact lug for the protective ground conductor connection and the metal housing.
Figure 3:
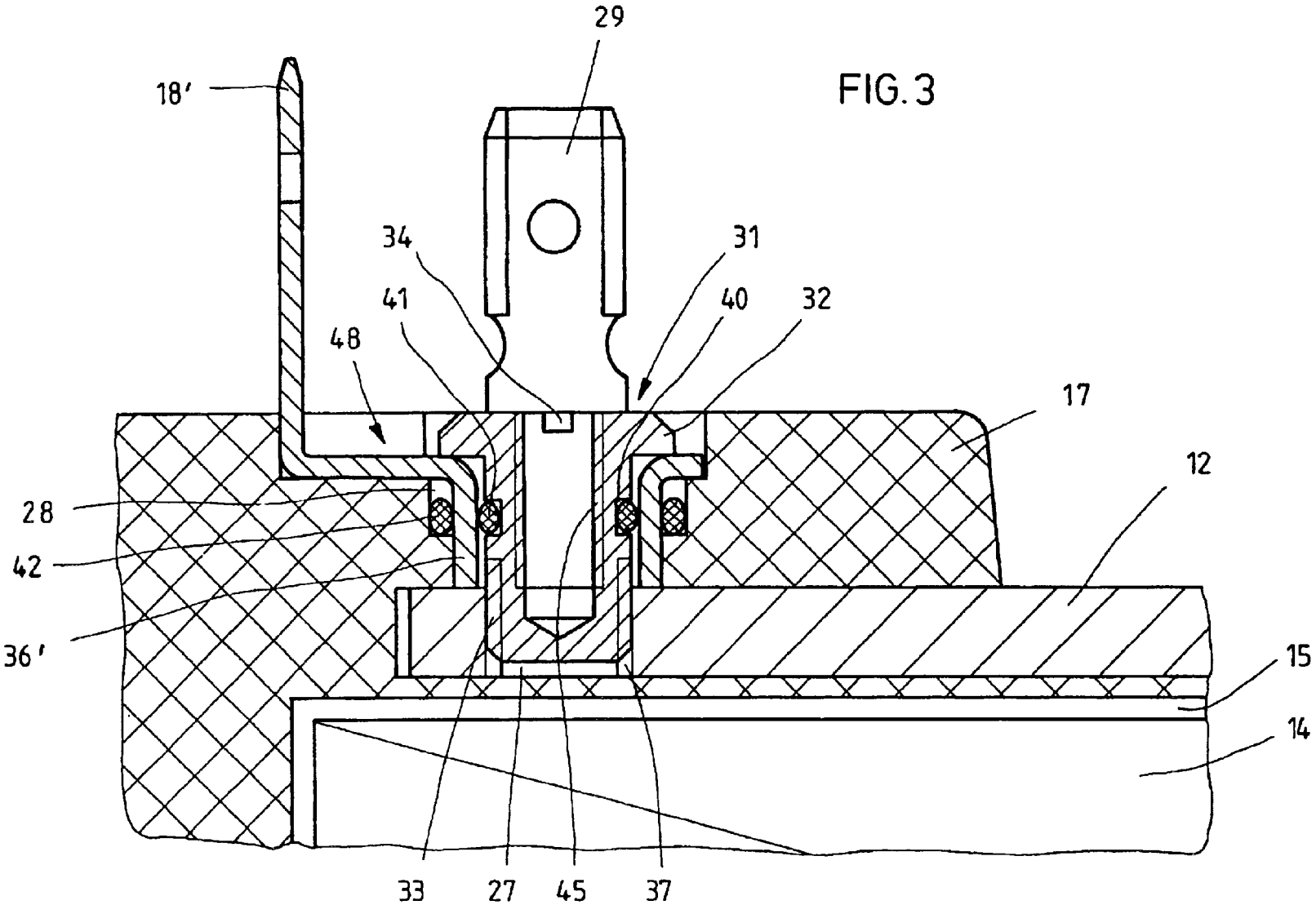
FIG. 3 shows a section through a detail of the magnet coil arrangement illustrated in FIG. 1, on an enlarged scale, in which the contact lug and the tubular metal part are formed integrally.

The coil pot 12 is provided with a recess 26, in the form of a slot, and with a hole 27. When the encapsulated coil 10 is pushed into the coil pot 12 during the assembly of the magnet coil arrangement, the recess 26 which is in the form of a slot clasps the web 25 which bounds the recess 23 at the sides. In the process, the wall of the coil pot 12 is pushed into the recess 23 until the hole 27 is located under a cutout 28 that is illustrated in FIGS. 2 and 3. The magnet coil arrangement is closed by pushing the pole plate 13 into the coil pot 12. The coil pot 12 and the pole plate 13 form the metal housing 11, which surrounds the encapsulated coil 10.

FIG. 2 shows a section through a detail of the magnet coil arrangement illustrated in FIG. 1, on an enlarged scale. This illustration shows the third contact lug, which is concealed by the contact lug 19 in FIG. 1 and is connected to the second end of the winding 14. This contact lug is provided with the reference symbol 29. A screw 31 made of electrically conductive material is used as a connecting element for the contact lug 18 and the coil pot 12. The screw 31 is provided with a head 32 and with a thread 33 at the end remote from the head 32. The head 32 is provided with a slot 34 for holding the blade of a screwdriver. A different geometry for holding a mounting tool can also be used instead of a slot 34. A tubular metal part 36 is arranged between the contact lug 18 and the coil pot 12, and is located within the cutout 28 in the plug cap 17. One end surface of the tubular metal part 36 rests on the contact lug 18, and the other end surface rests on the coil pot 12. The screw 31 is passed through a hole 35 in the contact lug 13 and through the tubular metal part 36. The hole 27, which is illustrated in FIG. 1, is provided with a thread 37, into which the thread 33 on the screw 31 is screwed. The contact lug 18 and the tubular metal part 36 are clamped in between the head 32 of the screw 31 and the coil pot 12. The tubular metal part 36 has essentially the same mechanical characteristics as the screw 31, and is primarily used as a spacer. The electric current which flows between the contact lug 18 and the coil pot 12 is split between two parallel paths, one of which passes via the screw 31, while the other passes via the tubular metal part 36.

The screw 31 is provided with an annular groove 40 in the area between the head 32 and the thread 33. A sealing ring 41 is held in the annular groove 40, and is used as a sealing element between the screw 31 and the inner wall of the tubular metal part 36. A further sealing ring 42 is used as a sealing element between the outer wall of the tubular metal part 36 and the inner wall of the cutout 28 in the plug cap 17. The cutout 28 has a circular cross section, particularly in the area of the sealing ring 42, that is to say in the sealing area. The sealing rings 41 and 42 prevent moisture which has entered via gaps between the encapsulated coil 10 and the metal housing 11 from passing on further into the connecting area 21 (see FIG. 1), and leading to corrosion there.

The screw 31 is provided with an internal thread 45, which is accessible from its head end. This is used for attachment of the housing 20, which is illustrated schematically in FIG. 1, of the connecting plug. The screw 31 is thus used not only for connection of the contact lug 18 (which is associated with the protective ground conductor connection) to the metal housing 11, but also for attaching the connecting plug to the plug cap 17 of the encapsulated coil 10.

FIG. 3 shows a section, corresponding to FIG. 2, through the magnet coil arrangement in the area of the plug cap 17. While the contact lug 18 and the tubular metal part 36 are separate components in FIG. 2, these two components are combined in FIG. 3 to form a common component 48 with a contact lug 18' and a tubular section 36'. The rest of its details correspond to those shown in FIGS. 2 and 3. The configuration of the contact lug and tubular metal part as one component reduces the number of individual parts. Furthermore, the component 48 can be handled more easily than two separate individual parts. This simplifies the process of assembly of the magnet coil arrangement. The component 48 can be produced at low cost as a deep-drawn or thermoformed part.

What is claimed is:

1. A magnet coil arrangement having an encapsulated coil which comprises a coil former provided with a winding and is extrusion coated with plastic, comprising a metal housing which is pushed over the encapsulated coil and surrounds it, a plug cap which is integrally formed on the encapsulated coil and is provided with contact lugs, one of which is coordinated to a protective ground conductor connection, a recess between the plug cap and the outer surface of the encapsulated coil, in which the metal housing engages, a connecting element which is passed through a cutout within the plug cap and using which the contact lug that is coordinated to the protective ground conductor connection is connected to the metal housing, and a sealing element which surrounds the connecting element, wherein a tubular metal part (36; 36') is arranged between the metal housing (12) and the contact lug (18; 18') which is coordinated to the protective ground conductor connection, wherein the connecting element (31) runs within the tubular metal part (36; 36'), wherein the sealing element (41) is arranged between the connecting elements (31) and the tubular metal part (36; 36'), and wherein a further sealing element (42) is arranged between the tubular metal part (36; 36') and the cutout (28) within the plug cap (17).

2. The magnet coil arrangement as claimed in claim 1, wherein the cutout (28) in the plug cap (17) has a circular cross section in a sealing area, and wherein the further sealing element (42) is in form of a sealing ring between the connecting element (31) and the tubular metal part (36; 36').

3. The magnet coil arrangement as claimed in claim 1, wherein the connecting element (31) is provided with an internal thread (45) for attachment of a connecting plug to the plug cap (17).

4. The magnet coil arrangement as claimed in claim 1, wherein the connecting element is in form of a screw (31) whose section which is provided with a thread (33) is screwed into the metal housing (12), with the tubular metal part (36; 36') being clamped in between a head (32) of the screw (31) and the metal housing (12).

5. The magnet coil arrangement as claimed in claim 4, wherein the sealing element (41) is in form of a sealing ring between the screw (31) and the tubular metal part (36; 36').

6. The magnet coil arrangement as claimed claim 5, wherein that section of the screw (31) which is located between the head (32) and the thread (33) is cylindrical and is provided with an annular groove (40).

7. The magnet coil arrangement as claimed in claim 1, wherein the tubular metal part (36') and the contact lug (18') which is coordianted to protective ground conductor connection are in form of a component (48).

8. The magnet coil arrangement as claimed in claim 7, wherein the tubular metal part (36') is integrally formed on the contact lug (18') which is coordinated to the protective ground conductor connection.

9. The magnet coil arrangement as claimed in claim 7, wherein the tubular metal part (36') and the contact lug (18') which is coordinated to the protective ground conductor connection are in form of a deep-drawn or thermoformed part.

* * * * *